US006702867B2

(12) United States Patent
Carman et al.

(10) Patent No.: US 6,702,867 B2
(45) Date of Patent: Mar. 9, 2004

(54) VITRIFIED BONDED ABRASIVE TOOLS

(75) Inventors: Lee A. Carman, Sutton, MA (US); Irvin F. Havens, Belfast, NY (US); Wesley A. King, Brighton, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 7 days.

(21) Appl. No.: 10/221,252

(22) PCT Filed: Mar. 23, 2001

(86) PCT No.: PCT/US01/09347

§ 371 (c)(1),
(2), (4) Date: Sep. 10, 2002

(87) PCT Pub. No.: WO01/70463

PCT Pub. Date: Sep. 27, 2001

(65) Prior Publication Data

US 2003/0205003 A1 Nov. 6, 2003

Related U.S. Application Data

(60) Provisional application No. 60/191,607, filed on Mar. 23, 2000.

(51) Int. Cl.[7] ..... B24D 3/02; B24D 3/04; B24D 3/14

(52) U.S. Cl. ..... 51/307; 51/309; 51/293; 51/308

(58) Field of Search ..... 51/307, 309, 293, 51/308

(56) References Cited

U.S. PATENT DOCUMENTS 5,129,919 A * 7/1992 Kalinowski et al. ..... 51/309
5,863,308 A * 1/1999 Qi et al. ..... 51/309
6,074,278 A * 6/2000 Wu et al. ..... 451/28

* cited by examiner

*Primary Examiner*—Michael Marcheschi
(74) *Attorney, Agent, or Firm*—Mary E. Porter

(57) ABSTRACT

The present invention provides a vitrified-bonded abrasive tool wherein the abrasive grit portion comprises a thermally sensitive abrasive grain, such as sintered sol gel microcrystalline alpha alumina abrasive grain or superabrasive grain, and wherein the vitrified bond may be matured by firing at a temperature of about 700 to 1,100 ° C. The invention preferably is carried out with sintered sol gel microcrystalline alpha alumina abrasive grain and a phosphorous oxide-containing, alkaliborosilicate vitrified bond composition. In one embodiment, during firing at about 700 to 1,100 ° C., the vitrified bond of the invention comprises at least two immiscible, amorphous phases.

27 Claims, No Drawings

VITRIFIED BONDED ABRASIVE TOOLS

This application is a 371 of PCT/US01/09347, filed Mar. 23, 2001 which claims priority of U.S. provisional application No. 60/191,607, filed Mar. 23, 2000.

BACKGROUND OF THE INVENTION

The invention relates to vitrified bonded abrasive tools made with a high strength, low temperature bond, comprising phosphorous oxide and boron oxide in amounts sufficient to improve the performance of an abrasive tool containing sintered sol gel alumina abrasive grain. As a result of the bond selection, sintered sol gel alumina abrasive grain (or other thermally labile abrasive grain) may be used effectively, without loss of grinding performance in the abrasive tool.

The invention further includes a vitrified bond composition suitable for firing at relatively low temperatures such as 700–1,100° C., comprising at least two amorphous, immiscible, glass phases. Abrasive tools comprising superabrasives (diamond or cubic boron nitride (CBN)), or seeded or unseeded sintered sol gel alumina abrasive grain, also referred to microcrystalline alpha-alumina (MCA) abrasive grain, are known to provide superior grinding performance on a variety of materials. The manufacture and characteristics of these MCA grains and the performance of these MCA grains in various applications are described in, for example, U.S. Pat. Nos. 4,623,364, 4,314,827, 4,744,802, 4,898,597 and 4,543,107, the contents of which are hereby incorporated by reference.

Vitrified or glass bonded abrasive tools containing MCA grain and superabrasive grain are commercially useful for grinding precision metal parts and other industrial components requiring consistent and improved grinding performance. To produce these types of abrasive tools with consistent quality, reactions between glass bond components and the abrasive grain must be avoided. Reactivity is a particular problem at typical temperatures encountered during firing of the bond, e.g., 1100–1400° C. Controlling these reactions minimizes damage to the critical microcrystalline structure of the MCA grain, preserving the grain sharpness and performance.

To reduce the amount of reaction between MCA grain and vitrified bond, U.S. Pat. No. 4,543,107 discloses a bond composition suitable for firing at a temperature as low as about 900° C. In an alternate approach, U.S. Pat. No. 4,898,597 discloses a bond composition comprising at least 40% fritted materials suitable for firing at a temperature as low as about 900° C. However, in certain grinding applications these low temperature bonds have demonstrated insufficient mechanical strength to meet commercial objectives prompting development of stronger bonds.

Vitrified bonds characterized by improved mechanical strength have been disclosed for use with either conventional fused alumina oxide or MCA (also referred to as sintered sol gel alpha-alumina) abrasive grits in manufacturing grinding wheels having improved form holding properties. Such bonds are described in U.S. Pat. No. 5,203,886, U.S. Pat. No. 5,401,284 and U.S. Pat. No. 5,536,283, which are hereby incorporated by reference. These vitrified bonds may be fired at relatively low temperatures (e.g., about 900–1100° C.) to avoid reaction with high performance, sintered sol gel alpha-alumina abrasive grain. The wheels made with these bonds and MCA grain have shown excellent performance in finishing precision moving parts, particularly ferrous metal parts. Other vitrified bonds suitable for use with MCA abrasive grain may be fired at temperatures below about 875° C. These bonds are disclosed in U.S. Pat. No. 5,863,308, which is hereby incorporated by reference.

It has now been discovered that by selecting appropriate material components, improved high strength, tough bonds may be made and fired at about 700 to 1,100° C., preferably 750 to 950° C. In particular, by selecting appropriate contents of phosphorous oxide, boron oxide, silica, aluminum oxide, alkali oxides and alkaline earth oxides, and by maintaining the correct ratios of oxides, one may achieve a high strength, tough (e.g., resistant to crack propagation), low temperature bond. These bonds are characterized by a 25% or larger increase in modulus of rupture value relative to comparative bonds of the prior art. In certain embodiments, bonds comprising at least two amorphous, immiscible, glass phases may be used with MCA grain to yield greater mechanical strength. While the appropriate selection of raw materials having the desired oxide ratios upon firing can achieve a glass with immiscible phases, fritted glasses are preferred for this purpose. A fritted glass is a glass formed by firing initially to temperatures of at least 1,200° C., cooling, crushing and sizing to yield a powdered material ("a frit"). The frit then may be melted at a temperature well below the initial firing temperature used to make the glass from the raw materials, such as silica and clays.

When formulating an abrasive tool, such as an abrasive wheel or hone, the use of these vitrified bonds with superabrasive or MCA grain, yields abrasive tools having improved grinding performance with reduced power draw. When used to grind or finish a workpiece, these abrasive tools yield very acceptable workpiece surface finishes. These tools offer improvements over the low temperature fired, vitrified bonded superabrasive or MCA grain tools previously known in the art.

The invention is an abrasive tool comprising at least 1%, by volume, MCA abrasive grain and 3 to 30%, by volume, vitrified bond, wherein the vitrified bond comprises after firing of the abrasive tool, 40 to 60% $SiO_2$, 10 to 18% $Al_2O_3$, 12 to 25% alkali oxides, 5 to 20% $B_2O_3$, and 1 to 8% $P_2O_5$, on a mole percent basis, and whereby the abrasive tool is characterized by at least a 30% increase in modulus of rupture relative to an comparable abrasive tool made with a vitrified bond comprising less than 1 mole % $P_2O_5$ The commonly used hardness grades of abrasive tools containing MCA grain (e.g., K grade and harder on the Norton Company scale) are characterized by having a modulus of rupture of at least 6,000 psi when made according to the invention.

The alkali oxides of the bond are selected from the group consisting of sodium oxide, lithium oxide and potassium oxide.

The abrasive tool preferably comprises 5 to 25 volume % vitrified bond and 10 to 56 volume % MCA abrasive grain, and may comprise about 0.1 to about 60 volume % of additional components selected from the group consisting of secondary abrasive grains, fillers and adjuncts. The vitrified bond after firing may comprise alkaline earth oxides, and the molar ratio of $SiO_2$ to the combined contents of $Na_2O$, alkali oxides other than $Na_2O$ and alkaline earth oxides is at least 1.2:1.0.

The invention further is an abrasive tool comprising at least 1%, by volume, MCA abrasive grain and 3 to 30%, by volume, of a vitrified bond, wherein the vitrified bond, during firing of the abrasive tool at about 700 to 1,100° C., comprises at least two immiscible phases, and whereby the abrasive tool is characterized by at least a 30% increase in modulus of rupture relative to an comparable abrasive tool having a single phase vitrified bond.

The vitrified bond having at least two immiscible phases preferably comprises a maximum of 12 mole % Al2O3.

Either bond may further comprise fluorine, $TiO_2$, ZnO, $ZrO_2$, CaO, MgO, CoO, $MnO_2$, BaO, $Bi_2O_3$, and $Fe_2O_3$, and combinations thereof.

The invention also includes a method for making an abrasive tool comprising the steps of:

a) mixing about 70 to 95 weight % abrasive grain selected from the group consisting of MCA grain, silicon carbide grain, diamond grain, and cubic boron nitride grain, and mixtures thereof, and about 5 to 30 weight % bond mixture, wherein the vitrified bond comprises after firing of the abrasive tool, 40 to 60% $SiO_2$, 10 to 18% $Al_2O_3$, 12 to 25% alkali oxides, 5 to 20% $B_2O_3$, and 1 to 8% $P_2O_5$, on a mole percent basis;

b) molding the mixture into a green composite; and c) firing the green composite at a temperature in the range of 700 to 1,100° C. to form the abrasive tool; and whereby the abrasive tool is characterized by at least a 30% increase in modulus of rupture relative to an comparable abrasive tool made with a vitrified bond comprising less than 1 mole % $P_2O_5$.

The method is particularly useful for abrasive grain selected from the group consisting of MCA grain, silicon carbide (SiC) grain, diamond grain, cubic boron nitride grain, and mixtures thereof. The firing step of this method may be carried out in an oxidizing atmosphere.

The invention further includes a microabrasive finishing tool, such as a hone or a stone, and grinding wheels made with MCA grain and having improved grinding performance, particularly in yielding a smooth surface finish on precision moving parts.

The vitrified bonded abrasive tools of the present invention comprise MCA abrasive grain. The MCA or sol-gel alumina grain are preferably produced by either a seeded or an unseeded sol gel process. As used herein, the term "sol-gel alumina grits" are alumina grits made by a process comprising peptizing a sol of an aluminum oxide monohydrate so as to form a gel, drying and firing the gel to sinter it, and then breaking, screening and sizing the sintered gel to form polycrystalline grains made of alpha alumina microcrystals (e.g., at least about 95% alumina).

In addition to the alpha alumina microcrystals, the initial sol may further include up to 15% by weight of spinel, mullite, manganese dioxide, titania, magnesia, rare earth metal oxides, zirconia powder or a zirconia precursor (which can be added in larger amounts, e.g. 40 wt % or more), or other compatible additives or precursors thereof. These additives are
often included to modify such properties as fracture toughness, hardness, friability, fracture mechanics, or drying behavior.

Many modifications of alpha alumina sol gel grain have been reported. All grains within this class are suitable for use herein and the term MCA grain is defined to include any grain comprising at least 60% alpha alumina microcrystals having at least 95% theoretical density and a Vickers hardness (500 grams) of at least 18 GPa at 500 grams. The microcrystals typically may range in size from about 0.2 up to about 1.0 microns for seeded grain and from greater than 0.2 to about 5.0 microns for unseeded grain. The sintered sol gel alpha-alumina grain may contain platlets of material other than alpha-alumina dispersed among the alpha-alumina microcrystals. Generally, the alpha-alumina particles and the platlets are submicron in size when made in this form.

The preparation of sintered sol gel alpha-alumina grains is described in detail elsewhere. Details of such preparations may be found, for example, in U.S. Pat. Nos. 4,623,364, 4,314,827, and 5,863,308, the contents of which are hereby incorporated by reference. Further details of MCA abrasive grain preparations and MCA abrasive grain types useful in the present invention may be found in any one of the numerous other patents and publications which cite the basic technology disclosed in the U.S. Pat. No. 4,623,364 and U.S. Pat. No. 4,314,827.

The abrasive tools of the invention comprise at least 1 volume % MCA abrasive grain and 3 to 30 volume % vitrified bond. The tools typically include 35 to 65 volume % porosity and, optionally, 0.1 to 60 volume % of one or more secondary abrasive grains, fillers and/or additives. The abrasive tools preferably comprise 3 to 56 volume % MCA abrasive grain. The amount of abrasive grain used in the tool and percentage of secondary abrasive may vary widely. The compositions of the abrasive tools of the invention preferably contain a total abrasive grain content from about 34 to about 56 volume %, more preferably from about 40 to about 54 volume %, and most preferably from about 44 to about 52 volume % grain.

The MCA abrasive preferably provides from about 1 to about 100 volume % of the total abrasive grain of the tool and more preferably from about 10 to 80 volume %, and most preferably, 30 to about 70 volume % of the total volume % abrasive grain in the tool.

When secondary abrasive grains are used, such abrasive grains preferably provide from about 0.1 to about 97 volume % of the total abrasive grain of the tool, and more preferably, from about 30 to about 70 volume %. The secondary abrasive grains which may be used include, but are not limited to, alumina oxide, silicon carbide, cubic boron nitride, diamond, flint and garnet grains, and combinations thereof.

The compositions of the abrasive tools optionally contain porosity. The compositions of the abrasive tools of the invention preferably contain from about 0.1 to about 68 volume % porosity, more preferably contain from about 28 to about 56 volume %, and most preferably contains from about 30 to about 53 volume %. The porosity is formed by both the natural spacing provided by the natural packing density of the materials and by conventional pore inducing media, including, but not limited to, hollow glass beads, ground walnut shells, beads of plastic material or organic compounds, foamed glass particles and bubble alumina, elongated grains, fibers and combinations thereof.

The abrasive tools of the present invention are bonded with a vitrified bond. The vitrified bond used contributes significantly to the improved grinding performance of the abrasive tools of the present invention.

The composition of the abrasive wheel preferably contains from about 3 to about 25 volume % bond, more preferably contains from about 4 to about 20 volume % bond, and most preferably contains from about 5 to about 18.5 volume % bond.

The raw materials for the bond may include clay, Kaolin, sodium silicate, alumina, lithium carbonate, borax pentahydrate, borax decahydrate or boric acid, and soda ash, flint, wollastonite, feldspar, sodium phosphate, calcium phosphate, and various other materials which have been used in the manufacture of vitrified bonds. Frits are preferably used in combination with the raw materials or in lieu of the raw materials. These bond materials in combination preferably contain the following oxides: $SiO_2$, $Al_2O_3$, $Na_2O$, $P_2O_5$ $Li_2O$, $K_2O$ and $B_2O_3$. Alkaline earth oxides, such as CaO, MgO and BaO, are frequently present, along with ZnO, ZrO, F, CoO, $MnO_2$, $TiO_2$, and $Bi_2O_3$.

$P_2O_5$ and $B_2O_3$ Containing Bonds

The bond after firing contains less than about 55 mole % $SiO_2$, preferably from about 40 to about 50 mole % $SiO_2$; less than about 12 mole % $Al_2O_3$, preferably from about 6 to about 11 mole % $Al_2O_3$; greater than about 2.5 mole % $Li_2O$, preferably from about 3.5 to about 8.0 mole % $Li_2O$; greater than about 8 mole % $B_2O_3$, preferably from about 10 to about 25 mole % $B_2O_3$, and about 1 to 8 mole % $P_2O_5$, preferably 2 to 6 mole % $P_2O_5$. In most bonds of the invention, alkali oxides include, on a bond mole % basis, from about 4 to about 16 mole % $Na_2O$, and more preferably from about 5 to about 10 mole % $Na_2O$; and about 2.5 to 6.0 mole %, of $K_2O$. Cobalt oxide (CoO) and other color sources are not necessary for the invention but may be included where bond color is desirable. Other oxides, such as $Fe_2O_3$ and $TiO_2$, and alkaline earth oxides including CaO, MgO and BaO, exist as impurities in the raw materials and may be present in or added to the bond of the invention.

Alkaline earth oxides may be used in the bond of the invention such that the vitrified bond after firing comprises a molar ratio of $SiO_2$ to the combined contents of alkaline earth oxides and alkali oxides of at least 1.2:1.0, when the bond comprises a maximum of 60 mole % $SiO_2$. Greater amounts of these combined oxides, relative to the $SiO_2$, may cause the bond of the invention to be too soft for many grinding operations.

Phosphorous oxide, in combination with boron oxide and controlled ratios of alkali oxides, has application in bonds which have proven to be particularly useful in making vitrified microabrasive stones and hones from MCA abrasive grain for precision finishing operations.

In a preferred embodiment, abrasive tools for superfinishing comprise MCA abrasive grain in a microabrasive grit size, and a vitrified bond comprising 40–55 wt % (46–59 mole %) of $SiO_2$, 15–25 wt % (10–18 mole %) of $Al_2O_3$, 11–21 wt % (12–25 mole %) in total of monovalent alkali metal oxide ($R_2O$) and divalent alkaline earth metal oxide (RO), 5–15 wt % (5–15 mole %) of $B_2O_3$ and 3–15 wt % (1–8 mole %) of $P_2O_5$, in amounts selected to yield a total of 100 wt % (or mole %).

These $P_2O_5$-containing vitrified bonds offer the following advantages. Because $P_2O_5$ serves to aid melting of the vitrified bond, it becomes possible to fire the superfinishing tool at a relatively low temperature of, e.g., 900° C. to 1,000° C., to avoid adverse effect on the grinding performance of MCA grain. Other components that aid melting of vitrified bonds include $B_2O_3$ and monovalent alkali metal oxides ($R_2O$), but these components tend to drastically lower the melt viscosity of the bond, and, therefore, present a problem in terms of stability of the vitrified bond during manufacture of the abrasive tool. These components can promote chemical reaction between the vitrified bond and the MCA abrasive grain, which may prevent the properties of the fine crystalline structure of the MCA grain from being expressed. In contrast, $P_2O_5$ causes little change in the melt viscosity of the bond, and allows the properties of the fine crystalline structure of the MCA grain to be expressed. While divalent alkaline earth metal oxides (RO) have the same action, it is not as notable as $P_2O_5$, $B_2O_3$ and monovalent alkali metal oxides ($R_2O$). The $P_2O_5$ component has good chemical affinity for $Al_2O_3$ components such as aluminum phosphate compounds.

The thermal expansion coefficient of the vitrified bond is preferably matched as closely as possible with the abrasive grits. Generally, when the difference between the thermal expansion coefficients of the abrasive grits and the vitrified bond is $\pm 2\times10^{-6}$ or greater, cracks occur in the bond and promote premature shedding of the abrasive grain. The thermal expansion coefficient for alumina abrasive grain is about $8.0\times10^{-6}$. The $B_2O_3$ component acts to lower the thermal expansion coefficient, and it is mainly used to aid melting of vitrified bonds employing superabrasive grains with a low thermal expansion coefficient. Monovalent alkali metal oxides ($R_2O$) act to increase the thermal expansion coefficient. Consequently, when $B_2O_3$ or a monovalent alkali metal oxide ($R_2O$) is added to aid in melting of the vitrified bond, the relative amount can prevent the thermal expansion coefficient from matching that of the abrasive grains, resulting in cracking of the bond and accelerated shedding of the abrasive grains. In contrast, while $P_2O_5$ has the effect of increasing the thermal expansion coefficient, the increase is not as great as with a monovalent alkali metal oxide ($R_2O$).

Addition of $P_2O_5$ to the vitrified bond allows firing to be accomplished at a temperature of 700° C. to 1,100° C., preferably 850° C. to 1,050° C., most preferably 900° C. to 1,000° C. while it undergoes effective chemical bonding with the fine crystalline sintered alumina abrasive grits and can closely match the thermal expansion coefficient of the abrasive grits to prevent premature loss of the abrasive grains from the tool during grinding, thus making possible a superfinishing abrasive tool with satisfactory grinding properties and a long usable life as a result of the enhanced sharpness and grinding action provide by the fine crystalline sintered alumina abrasive grits. Particularly superior performance may be obtained by including $P_2O_5$ at 3–15 wt % (1–8 mole %) of the bond. The $P_2O_5$ component exhibits peak performance at 6–12 wt % (2.5–6.5 mole %).

When $SiO_2$ content is less than 40 wt % the strength of the bond is reduced, and when it is greater than 55 wt % the melt temperature increases, so that a higher firing temperature is required. When the $Al_2O_3$ content is less than 15 wt % a problem results in terms of bond stability, and at greater than 25 wt % the melting temperature of the bond increases, so that a higher firing temperature is required. When the $R_2O$ (where R is an alkali metal)+RO (where R is an alkaline earth metal) content is less than 11 wt %, the melting temperature of the bond increases so that a higher firing temperature is required, and when it is greater than 21 wt % a problem results in terms of bond stability. When the $B_2O_3$ content is less than 5 wt %, the melting temperature of the bond increases so that a higher firing temperature is required, and when it is greater than 15 wt % a problem results in terms of bond stability.

Immiscible Phase Bonds

The phase separated glass bonds of the invention may be prepared from any glass composition susceptible to phase separation under the conditions useful for manufacture of abrasive tools comprising MCA abrasive grain or other thermally and/or chemically labile grain. Phase separation occurs when a single phase glass separates into two glass phases, each having a distinct chemical composition and material properties. When glass is in a liquid state, the liquid phases are immiscible.

In the case of abrasive tools, amorphous phase separation into immiscible phases allows one to obtain a high strength, tough, glass bond at a relatively low processing temperature. By careful control of oxide ratios in the glass and selection of frits, the majority, or matrix phase of the glass bond will be matured into a higher temperature glass, capable of imparting strength and toughness to the abrasive tool. The minority, or discontinuous phase will be matured into a lower temperature glass, capable of flowing, wetting and bonding the abrasive grains in the relatively low temperature range of 700 to 1,100° C.

A preferred embodiment of the phase separated vitrified bond combines phosphates, e.g., phosphorous oxide derived from sodium or calcium phosphate raw materials, to lower the firing temperature with silicate components to lend mechanical strength. The silicate components are preferably provided as an alkaliborosilicate glass system, e.g., $Na_2O$—$B_2O_3$—$Al_2O_3$—$SiO_2$, or $Na_2O$—$B_2O_3$—$SiO_2$. The amount of aluminum oxide must be controlled as an excess (e.g., more than 12 mole % in a typical vitrified bond system) will tend to prevent separation into immiscible phases. Higher amounts of boron relative to alkali improve phase separation. Ratios of boron oxide to alkali oxide of 5.25:1 to 1:1 are preferred, and the precise ratio depends upon the amount of aluminum oxide present and whether other modifiers are being used. The addition of other modifiers, such as CaO, MgO, alkali oxides and fluorides, in amounts up to about 2 mole %, typically will enhance separation, particularly when used with phosphorous materials. Oxides such as lithium oxide may be substituted for sodium oxide, particularly when a frit is used.

Without being bound by any particular theory, it is believed the phase-separated bonds are an improvement over similar, non-phase separated bonds for several reasons. The immiscible phase glass bonds yield stronger bond behavior at lower processing temperatures, or they yield increased abrasive tool strength after processing at conventional bond firing temperatures. An increased abrasive tool toughness is due to crack tip blunting or deflection as the crack propagates through the residual stress fields resulting from a multi-phase solid system. Control is improved over the reaction between abrasive grain and bond as a result of the lowered firing temperatures and the separation of more grain reactive components (e.g., alkali oxides) into the desired phase.

Enhanced grinding performance can be expected as a result of certain lower temperature glass phases undergoing glass transition during grinding. This should increase the effective heat capacity of the abrasive tool, thereby acting to remove heat of grinding from the surrounding abrasive grain and workpiece.

In manufacturing the abrasive tools containing these bonds, organic binders are preferably added to powdered bond components, fritted or raw, as molding or processing aids. These binders may include dextrins and other types of glue, a liquid component, such as water or ethylene glycol, viscosity or pH modifiers and mixing aids. Use of binders improves wheel uniformity and the structural quality of the pre-fired or green pressed wheel and the fired wheel. Because the binders are burned out during firing, they do not become part of the finished bond or abrasive tool.

The abrasive wheels may be fired at the relatively low temperatures indicated herein by methods known to those skilled in the art. The firing conditions are primarily determined by the actual bond and abrasives used. The bond is fired at 700 to 1,100° C., preferably 750 to 950° C., to provide the mechanical properties necessary for grinding metals and other workpieces. The vitrified bonded body further may also be impregnated after firing in a conventional manner with a grinding aid, such as sulfur or wax, or with a vehicle, such as epoxy resin, to carry a grinding aid into the pores of the wheel.

For microabrasive grain used in abrasive tools for, e.g., superfinishing operatoins, the particle size of the abrasive grits used is typically about 2 to 6 microns (280-6000 JIS grade), but a fine particle size of 18 microns (1000 JIS) or smaller is more common. The bond hardness of the abrasive tool is from +100 to −60 in terms of Rockwell hardness, with +100 being harder and −60 being softer.

The dimensions and shape of the superfinishing tool are generally determined by the workpiece and the mechanical structure. Minimum dimensions are about 2×2×15 mm and maximum dimensions about 25×50×120 mm, but larger and smaller dimensions than these are also possible. The shape is most usually rectangular (i.e., a stone or a hone) but rounded ends are sometimes provided.

The superfinishing tools generally comprise 32%–46%, by volume, abrasive grain, 5%–20%, by volume, vitrified bond and 40–55%, by volume porosity.

The following Examples are provided by way of illustration of the invention, and not by way of limitation.

EXAMPLE 1

Fine crystalline sintered alumina (MCA) abrasive grain obtained from Saint-Gobain Industrial Ceramics, Inc., Worcester, Mass., (trade name: Norton SG abrasive grain, grit size: 5 microns (JIS #3000) and commercially available fused white alumina abrasive grain (from the same source, trade name: WA, grit size: 5 microns (JIS #3000) were used in an equal weight ratio (50:50), and the low temperature firing vitrified bond disclosed in Japanese Unexamined Patent Publication No. 8-90422 was used for modified bonds (1) to (3) with the chemical compositions listed in Table 1, to fabricate superfinishing grinding tools (1) to (3) as shown in Table 2.

For comparison there was used a superfinishing grinding tool comprising 100% of the most common commercially used fused white alumina abrasive grits (commercial product A). The structure for the superfinishing grinding tools was an abrasive grit volume of 37%, a vitrified bond volume of 9% and a pore volume of 54%, and the hardness of the vitrified superfinishing grinding tool was in the range of −30 to −40 on the Rockwell hardness H scale (⅛" scale, 60 kgf load).

TABLE 1

| | Test bond chemical components wt % | | | | | |
|---|---|---|---|---|---|---|
| Test No. | $SiO_2$ | $Al_2O_3$ | RO | $R_2O$ | $B_2O_3$ | Total |
| Bond (1) | 48.0 | 17.0 | 2.0 | 15.0 | 19.0 | 100.0 |
| Bond (2) | 51.0 | 21.0 | 1.0 | 18.0 | 9.0 | 100.0 |
| Bond (3) | 51.0 | 21.0 | 1.0 | 8.0 | 20.0 | 100.0 |

These bonds were selected because they represent the lowest temperature firing bonds among the publicly known bonds and they are suitable for maturing at 900° C.

TABLE 2

| | Test grinding tool mixtures | | |
|---|---|---|---|
| | Abrasive grits | | |
| Test grinding tool No. | WA | SG | Test bond No. |
| Test grinding tool (1) | 50 | 50 | Bond (1) |
| Test grinding tool (2) | 50 | 50 | Bond (2) |
| Test grinding tool (3) | 50 | 50 | Bond (3) |
| Commercial product (A) | 100 | | |

Test Grinding Tool Mixing Procedure and Grinding Conditions

Fired grinding tools were obtained by stirring and mixing 5 parts by weight of a 30% dextrin aqueous solution and each vitrified bond with 100 parts by weight of each of the abrasive grits, WA and WA+Norton SG®, in a manner such that the volume percentages of tool components were, respectively, an abrasive grit volume of 37%, a vitrified bond volume of 9% and a pore volume of 54%, based on the bulk specific gravity of the grinding tool. Then, square grinding tools were molded to dimensions of 60×12×25 mm.

After molding test grinding tools (1) to (3), the grinding tools were dried and then fired for a prescribed period of 30 hours, with 2 hours at the maximum temperature of 900° C. These grinding tools were subjected to Rockwell hardness measurement and were then cut to prescribed dimensions and used in a grinding test. For comparison, a superfinishing grinding tool with 100% commercially available fused white alumina abrasive grain was also tested.

The grinding test employed a superfinishing disk (product of Seibu Jido Kiki) and a non-water-soluble mineral oil as the grinding fluid, a SUJ-2 (58/62 by HRC) workpiece and grinding tool dimensions of 10 mm length, 5 mm width and 20 mm depth, the grinding tool operating surface had a 10 mm width in the circumference direction, a 5 mm width in the axis direction and 20 mm in the abrading direction, and the working dimensions were a 50 mm diameter and 5 mm width, with plunge grinding being effected on the outer circumference. The surface roughness of the grinding target before the test was 1.3 $\mu$mRz. The superfinishing conditions were a grinding tool vibration frequency of 1785 cpm, a work rotation rate of 197 rpm, a tool amplitude of 2 mm, and a maximum inclination angle of 200, with one minute each under these conditions.

TABLE 3

Test Results

| | Rockwell hardness | Grinding volume | Grinding tool durability | Grinding ratio | *Surface roughness |
|---|---|---|---|---|---|
| Test grinding tool (1) | −33 | 70 | 80 | 56 | 96 |
| Test grinding tool (2) | −37 | 98 | 105 | 103 | 100 |
| Test grinding tool (3) | −34 | 98 | 101 | 99 | 99 |
| Commercial product (A) | −38 | 100 | 100 | 100 | 100 |

*Note:
A smaller value for surface roughness indicates better surface finish.

As shown by the results in Table 3, where the commercial product (A) is shown as a reference, the test grinding tool (1) exhibited inferior performance to the commercial product, and the test bond (2) and test bond (3) had inferior cutting volume but slightly better durability. However, despite employing MCA abrasive grain, the comparative examples exhibited almost no superior performance, and especially grinding properties, compared to the commercial product (A) grinding tool that employed fused white alumina abrasive grits.

EXPERIMENTAL EXAMPLES

Bonds (11) to (16) with the chemical compositions shown in Table 4 were used to fabricate the test grinding tools (11) to (18) listed in Table 5 in the same manner as the test grinding tools (1) to (3) of the comparative examples, and these were subjected to a grinding test in the same manner as the comparative examples. The results are shown in Table 6.

TABLE 4

Test Bond chemical components wt % (mole %)

| Test No. | $SiO_2$ % wt (mole) | $Al_2O_3$ % | RO + $R_2O$ % | $B_2O_3$ % | $P_2O_5$ % | Total |
|---|---|---|---|---|---|---|
| Bond (11) | 51.0 (56.0) | 21.0 (13.5) | 19.0 (20.0–23.5) | 9.0 (8.5) | 0.0 (0) | 100.0 (100.0) |
| Bond (12) | 50.0 | 20.5 | 19.0 | 7.5 | 3.0 (1.0) | 100.0 |
| Bond (13) | 49.5 | 20.5 | 17.0 | 7.0 | 6.0 | 100.0 |
| Bond (14) | 48.5 | 20.0 | 16.0 | 6.5 | 9.0 | 100.0 |
| Bond (15) | 48.0 | 19.0 | 16.0 | 5.0 | 12.0 | 100.0 |
| Bond (16) | 46.0 (55.0) | 18.0 (12.7) | 16.0 (18.4–21.0) | 5.0 (5.1) | 15.0 (7.6) | 100.0 (100.0) |

TABLE 5

Test grinding tool mixtures

| Test tool No. | Abrasive Grits WA | Abrasive Grits SG | Test bond No. |
|---|---|---|---|
| Test tool (11) | 100 | | Bond (11) |
| Test tool (12) | 50 | 50 | Bond (11) |
| Test tool (13) | 50 | 50 | Bond (12) |
| Test tool (14) | 50 | 50 | Bond (13) |
| Test tool (15) | 50 | 50 | Bond (14) |
| Test tool (16) | 100 | | Bond (14) |
| Test tool (17) | 50 | 50 | Bond (15) |
| Test tool (18) | 50 | 50 | Bond (16) |
| Commercial product (A) | 100 | | |

TABLE 6

Test Grinding Tool Properties

| | Rockwell hardness | Grinding volume | Grinding tool durability | Grinding ratio (G-ratio) | *Surface roughness |
|---|---|---|---|---|---|
| Test tool (11) | −38 | 95 | 97 | 92 | 99 |
| Test tool (12) | −37 | 98 | 105 | 103 | 101 |
| Test tool (13) | −37 | 106 | 128 | 136 | 102 |
| Test tool (14) | −39 | 110 | 183 | 201 | 104 |
| Test tool (15) | −38 | 115 | 248 | 286 | 104 |
| Test tool (16) | −36 | 103 | 115 | 119 | 102 |
| Test tool (17) | −37 | 117 | 239 | 280 | 104 |

TABLE 6-continued

Test Grinding Tool Properties

| | Rockwell hardness | Grinding volume | Grinding tool durability | Grinding ratio (G-ratio) | *Surface roughness |
|---|---|---|---|---|---|
| Test tool (18) | −36 | 110 | 163 | 180 | 103 |
| Commercial product (A) | −38 | 100 | 100 | 100 | 100 |

*Note:
A smaller value for surface roughness indicates better surface finish.

The Rockwell hardnesses of all of the test grinding tools were in the range of −30 to −40. No burns were found on any of the workpieces. Those grinding tools with larger grinding volumes than the commercial product (A) had slightly inferior surface roughness compared to the commercial product (A). This is because a larger grinding volume tends to result in a poorer surface roughness. However, these values were within the acceptable range.

Table 6 shows that the test grinding tool (11) which contained 100 wt % fused white alumina abrasive grits and no $P_2O_5$ in the vitrified bond exhibited inferior performance with respect to the commercial product (A) as reference. The performance was generally improved when MCA abrasive grain was used. The grinding tools containing $P_2O_5$ in the vitrified bonds also exhibited better performance. In particular, test grinding tools (14), (15) and (17), which included MCA abrasive grain and contained $P_2O_5$ at 6–12 wt % in the vitrified bond, had grinding volumes improved by 10% or more and grinding ratios of twice or higher, with peak performance being exhibited with 9–12 wt % $P_2O_5$ in the vitrified bond. The test grinding tool (18) which had 15 wt % $P_2O_5$ in the vitrified bond exhibited 1.8 times the performance of the commercial product (A), but its performance was inferior to the test grinding tool (17).

As regards the test grinding tool (15) that included MCA abrasive grain and the test grinding tool (16) that contained no MCA abrasive grain, the test grinding tool (15) that included MCA abrasive grain exhibited over twice the G-ratio as the test grinding tool (16) that contained no MCA abrasive grain. Thus, MCA abrasive grain and a vitrified bond containing $P_2O_5$ produced better performance.

EXAMPLE 2

Test bar samples were made for testing the mechanical strength properties of experimental bonds for abrasive tools made according to the invention. Raw materials to make the fired experimental bond compositions as set forth in Table 7 were selected from kaolin clay, soda ash, sodium silicate, lithium carbonate, (Ca, Mg)O, borax, boric acid, cryolite, feldspar, sodium phosphate, calcium phosphate, titanium dioxide, and a powdered glass frit. The powdered glass frit had the composition:

Frit Composition (Weight %)

| Oxide | Frit |
|---|---|
| $SiO_2$ | 54.1 |
| $Na_2O$ | 7.7 |
| $B_2O_3$ | 38.2 |

The bond mixture was produced by dry blending small quantities (about 100 g) of the raw materials in a laboratory mixer to make a powdered bond pre-mixture. Preliminary firing tests on pats made from these bond mixtures confirmed that the experimental bonds matured into a glass bond at 900° C.

The mole percentage compositions for the fired experimental bonds are shown in Table 7, below

TABLE 7

Mole % Compositions of Experimental Bonds After Firing

| | $SiO_2$ | $Al_2O_3$ | $B_2O_3$ | $P_2O_5$ | F | $NaO_2$ | $K_2O$ | $Li_2O$ |
|---|---|---|---|---|---|---|---|---|
| Experimental Bonds | | | | | | | | |
| Bond 2 | 41.55 | 11.97 | 15.00 | 4.90 | 0.00 | 12.97 | 2.98 | 4.98 |
| Bond 3 | 45.48 | 11.99 | 14.99 | 0.00 | 0.00 | 10.99 | 2.99 | 7.99 |
| Bond 12 | 40.09 | 11.59 | 14.48 | 4.76 | 4.78 | 8.12 | 2.99 | 7.79 |
| Bond 21 | 42.00 | 11.57 | 14.44 | 2.26 | 4.77 | 9.13 | 5.39 | 4.90 |
| Bond 24 | 44.48 | 11.99 | 10.99 | 4.99 | 0.00 | 10.99 | 2.99 | 7.99 |
| Comparative Bonds | | | | | | | | |
| Bond 9 | 41.34 | 12.00 | 15.00 | 5.00 | 0.00 | 16.02 | 2.99 | 1.99 |
| Bond 11 | 43.60 | 11.54 | 14.49 | 0.04 | 4.75 | 4.73 | 7.74 | 7.73 |
| Bond 13 | 46.38 | 11.58 | 6.78 | 4.60 | 4.72 | 4.86 | 7.77 | 7.78 |
| Bond 15 | 41.47 | 12.01 | 15.00 | 4.99 | 0.00 | 4.93 | 8.00 | 8.00 |
| Bond 20 | 46.21 | 11.78 | 10.76 | 2.47 | 2.47 | 15.85 | 2.97 | 1.97 |

These experimental and comparative bonds also contained about 1.38–1.51 mole % $TiO_2$, 2.38–2.58 mole % CaO, and 1.38–1.54 mole % MgO, to yield a total of 100 mole %.

The bonds were combined with an MCA abrasive grain, obtained from Norton Company (Norton SG® 80 grit, MCA abrasive grain). The grain and a liquid organic binder component were mixed in a small laboratory mixer. The bond pre-mixture was then added and mixed with the grain.

The mix was screened through a screen to break-up any lumps and then pressed into bars with dimensions of 10.16 cm×2.54 cm×1.77 cm (4"×1"×½") in a three cavity bar mold setup. Losses on ignition were calculated and specific gravity of the glass for each bond were considered in adjusting the weight percentages of the bond components used in each test sample to yield experimental abrasive tools having approximately the same hardness after firing (i.e., a K grade of hardness on the Norton Company scale). Test bars comprised about 9 volume % of glass bond component, 48 volume % MCA abrasive grain, and 43 volume % porosity.

The bars were fired in an electric kiln under the following firing conditions: temperature ramped at 25° C./hour from room temperature to 350° C.; held for 2 hours; ramped at 25° C./hour to 900° C. peak temperature; held for 8 hours at that peak temperature; and cooled to room temperature.

The bars were tested for modulus of rupture on an Instron Model 47727 mechanical testing machine with a 4-point bending jig with a support span of 3", a load span of 1", and at a loading rate of 0.050" per minute cross head speed. Sand blast penetration data was generated by testing bars in a Norton Co. sandblast grading machine (#2 chamber) at 15 psi for 10 seconds. Modulus of elasticity was determined utilizing a Grindo-Sonic MK3S tester. The results (average of 6 samples) are shown in Table 9.

TABLE 9

Test Bar Strength and Hardness

| | Fired Density g/cc | Modulus of Elasticity GPa | Modulus of Rupture (psi) | Sand Blast Penetration mm |
|---|---|---|---|---|
| Experimental Bond | | | | |
| Bond 2 | 2.080 | 41.55 | 6575 | 2.59 |
| Bond 3 | 2.082 | 43.53 | 6641 | 3.60 |
| Bond 12 | 2.091 | 45.59 | 6874 | 2.32 |
| Bond 21 | 2.077 | 43.10 | 6533 | 2.46 |
| Bond 24 | 2.073 | 43.40 | 6581 | 2.40 |
| | | | 6641 ave. | |
| Comparative Bond | | | | |
| Bond 9 | 2.068 | 39.96 | 5175 | 2.90 |
| Bond 11 | 2.081 | 44.20 | 5115 | 2.59 |
| Bond 13 | 2.089 | 38.39 | 3799 | 3.71 |
| Bond 15 | 2.085 | 44.50 | 5816 | 2.22 |
| Bond 20 | 2.067 | 35.20 | 4515 | 3.52 |
| | | | 4884 ave. | |

The test results indicate all experimental bonds had matured during firing at a temperature of 900° C. to create a bond with sufficient strength and mechanical properties to be useful in abrasive tools suitable for grinding operations.

The relatively low firing temperature and the oxide chemistry of the bonds, both experimental and comparative, were selected for compatibility with MCA abrasive grain and were appropriate for conserving the superior grinding performance of the MCA abrasive grain. However, relative to the comparative bonds, the experimental bonds also yielded an unexpected boost in bond strength as demonstrated by the modulus of rupture (MOR) and other strength indicators (SBP and MOE).

The maximum MOR was obtained when both boron oxide and phosphorous oxide were present. Insufficient boron (6.78%) in bond 13, even in the presence of phosphorous (4.60%) and fluorine (4.72%), caused a drop in MOR. In bond 24, the combined quantities of boron (10.99%) and phosphorous (4.99%) were sufficient to yield over 6,000 psi MOR. Unlike the phosphorous, added fluorine (4.75%) did not have the same beneficial effect in combination with the boron (14.49%) in bond 11.

Each of the comparative examples had a MOR of less than 6,000 psi, demonstrating insufficient mechanical strength in the glass bond for use in abrasive tools comprising MCA abrasive grain. The average difference in MOR between the experimental samples and the comparative samples represents about a 35% improvement in strength.

An excess of alumina (i.e., 12 mole % or higher), and an imbalance of potassium and lithium oxides with each other, or with sodium oxide, resulted in an unsatisfactory MOR and insufficient bond strength for use in the abrasive tools of the invention. Comparative bonds 9 and 15 illustrate the effects of an excess of alumina and comparative bonds 9, 11 and 15 illustrate the effects of an imbalance in the alkali oxide content.

EXAMPLE 3

Test bar sample (A) is made as described for Bond 12 in Example 2, except that sample A comprises 47% $SiO_2$, 10% $Al_2O_3$, 4% $Na_2O$, 2.5% $Li_2O$, 2.5% $K_2O$, 25% $B_2O_3$, and 5% $P_2O_5$, on a mole percent basis. Test bar A is examined to evaluate whether at least two immiscible, amorphous phases are created during firing of the glass bonds.

Sections of the test bars are examined by scanning electron microscopy at a magnification of 10,000×. At least two separate glass phases are observed in test bar A containing the bond of the invention. Single glass phases are observed in the Comparative Bonds.

Thus, an abrasive tool made with an alkaliborosilicate glass comprising at least 1 mole % $P_2O_5$, a minimum of 8 mole % $B_2O_3$, a ratio of at least 2:1 of boron to alkali oxide, and less than 12 mole % $Al_2O_3$, contains separate glass phases when fired at 900° C with MCA grain.

It is understood that various other modifications will be apparent to and can be readily made by those skilled in the art without departing from the scope and spirit of the present invention. Accordingly, it is not intended that the scope of the claims be limited to the description set forth above. The claims should be construed as encompassing all of the features of patentable novelty which reside in the present invention, including all features considered by those skilled in the art to be equivalents thereof.

What is claimed is:

1. An abrasive tool having a modulus of rupture of at least 6,000 psi, comprising at least 1%, by volume, MCA abrasive grain and 3 to 30%, by volume, of a vitrified bond, wherein the vitrified bond, during firing of the abrasive tool at about 700 to 1,100° C., comprises at least two immiscible phases.

2. The abrasive tool of claim 1, wherein the vitrified bond is prepared from bond components comprising a glass frit.

3. The abrasive tool of claim 1, wherein the immiscible phases of the vitrified bond during firing of the abrasive tool are amorphous phases.

4. The abrasive tool of claim 1, wherein the vitrified bond comprises a major amount of an alkaliborosilicate glass.

5. The abrasive tool of claim 4, wherein at least one of the immiscible phases of the vitrified bond during firing of the abrasive tool comprises 1 to 8 mole % $P_2O_5$.

6. The abrasive tool of claim 4, wherein the vitrified bond comprises a minimum of 8 mole % $B_2O_3$, and less than 12 mole % $Al_2O_3$.

7. The abrasive tool of claim 1, wherein the tool comprises 4 to 25 volume % vitrified bond and 10 to 56 volume % MCA abrasive grain.

8. The abrasive tool of claim 7, wherein the tool further comprises about 0.1 to 60 volume % of additional components selected from the group consisting of secondary abrasive grains, fillers and adjuncts.

9. The abrasive tool of claim 7, wherein the MCA abrasive grain is selected from the group consisting essentially of alpha-alumina microcrystalline grain manufactured by a seeded sol-gel process, alpha-alumina microcrystalline grain manufactured by an unseeded sol-gel process, modifications thereof with rare earth metal oxides, and combinations thereof.

10. The abrasive tool of claim 4, wherein the vitrified bond comprises a molar ratio of $B_2O_3$ to alkali oxides of 5.25:1 to 1:1.

11. The abrasive tool of claim 4, wherein the alkali oxides are selected from the group consisting of $Na_2O$, $Li_2O$, and $K_2O$ and combinations thereof.

12. The abrasive tool of claim 4, wherein the vitrified bond after firing further comprises a maximum of 2 mole % of a component selected from the group consisting of fluorine containing components, ZnO, $ZrO_2$, CaO, MgO and combinations thereof.

13. An abrasive tool comprising at least 1%, by volume, MCA abrasive grain and 3 to 30%, by volume; vitrified bond, wherein the vitrified bond comprises after firing of the abrasive tool, 40 to 60% $SiO_2$, 10 to 18% $Al_2O_3$, 12 to 25% alkali oxides, 5 to 20% $B_2O_3$ and 1 to 8% $P_2O_5$, on a mole percent basis, and whereby the abrasive tool is characterized by at least a 30% increase in modulus of rupture relative to an comparable abrasive tool made with a vitrified bond comprising less than 1 mole at $P_2O_5$.

14. The abrasive tool of claim 10, wherein the alkali oxides are selected from the group consisting of $Na_2O$, $Li_2O$, and $K_2O$ and combinations thereof.

15. The abrasive tool of claim 13, wherein the vitrified bond is fired at 700–1,100° C.

16. The abrasive tool of claim 13, wherein the tool comprises 4 to 25 volume % vitrified bond and 10 to 56 volume % MCA abrasive grain.

17. The abrasive tool of claim 16, wherein the tool further comprises about 0.1 to about 60 volume % of additional components selected from the group consisting of secondary abrasive grains, fillers and adjuncts.

18. The abrasive tool of claim 10, wherein the MCA abrasive grain is selected from the group consisting essentially of alpha-alumina microcrystalline grain manufactured by a seeded sol-gel process, alpha-alumina microcrystalline grain manufactured by an unseeded sol-gel process, modifications thereof with rare earth metal oxides, and combinations thereof.

19. The abrasive tool of claim 10, wherein the vitrified bond after firing further comprises a maximum of 2 mole % of at least one oxide selected from the group consisting of $TiO_2$, ZnO, $ZrO_2$, CaO, MgO, CoO, $MnO_2$, BaO, $Bi_2O_3$ and $Fe_2O_3$, and combinations thereof.

20. The abrasive tool of claim 19, wherein the vitrified bond after firing comprises alkaline earth oxides and the molar ratio of $SiO_2$ to the combined contents of alkali oxides and alkaline earth oxides is at least 1.5:1.0.

21. A method for making an abrasive tool having a modulus of rupture of at least 6,000 psi, comprising the steps of:

a) mixing about 70 to 95 weight % abrasive grain selected from the group consisting of MCA grain, silicon carbide grain, diamond grain, and cubic boron nitride grain, and mixtures thereof, and about 5 to 30 weight % bond mixture, the bond mixture comprising, after firing of the abrasive tool, 40 to 60% $SiO_2$, 10 to 18% $Al_2O_3$, 12 to 25% alkali oxides, 5 to 20% $B_2O_3$, and 1 to 8% $P_2O_5$, on a mole percent basis;

b) molding the mixture into a green composite; and c) firing the green composite at a temperature in the range of 700 to 1,100° C. to form the abrasive tool;

and whereby the abrasive tool is characterized by at least a 30% increase in modulus of rupture relative to an comparable abrasive tool made with a vitrified bond comprising less than 1 mole % $P_2O_5$.

22. The method of claim 21, wherein the green composite is fired at a temperature less than about 950° C.

23. The method of claim 21, wherein the abrasive tool is selected from the group consisting of grinding wheels, abrasive stones and abrasive hones.

24. The method of claim 21, wherein the firing step is carried out in an oxidizing atmosphere.

25. The method of claim 23, wherein the abrasive tool is a microabrasive superfinishing tool.

26. The abrasive tool of claim 4, wherein the vitrified bond comprises alkali oxides in a ratio of 1:1:1 to 2:1:1 of sodium:lithium:potassium.

27. The abrasive tool of claim 13, wherein the vitrified bond comprises alkali oxides in a ratio of 1:1:1 to 2:1:1 of sodium:lithium:potassium.

* * * * *